US007017781B2

(12) United States Patent
Provenza

(10) Patent No.: US 7,017,781 B2
(45) Date of Patent: Mar. 28, 2006

(54) COLLAPSIBLE CONTAINER FOR LIQUIDS

(75) Inventor: Frank L. Provenza, Wylie, TX (US)

(73) Assignee: Dr Pepper/Seven-Up, Inc., Plano, TX (US)

( * ) Notice: Subject to any disclaimer, the term of this patent is extended or adjusted under 35 U.S.C. 154(b) by 0 days.

(21) Appl. No.: 11/195,279

(22) Filed: Aug. 2, 2005

(65) Prior Publication Data

US 2005/0274736 A1 Dec. 15, 2005

Related U.S. Application Data

(63) Continuation of application No. 10/257,351, filed as application No. PCT/US01/12203 on Apr. 13, 2001.

(60) Provisional application No. 60/196,838, filed on Apr. 13, 2000.

(51) Int. Cl.
*B65D 35/56* (2006.01)
*B65D 35/08* (2006.01)
*B65D 35/16* (2006.01)

(52) U.S. Cl. ..... 222/105; 222/107

(58) Field of Classification Search ..... 222/92, 222/105, 107, 181.1, 181.2, 181.3; 229/117.27, 229/117.35; 383/119, 206
See application file for complete search history.

(56) References Cited

U.S. PATENT DOCUMENTS

| | | | |
|---|---|---|---|
| 2,133,411 | A | 10/1938 | Zohe |
| 2,569,975 | A | 10/1951 | Cone |
| 2,672,268 | A | 3/1954 | Bower |
| 2,714,557 | A | 8/1955 | Mahaffy |
| 2,778,171 | A | 1/1957 | Taunton |
| 2,778,173 | A | 1/1957 | Taunton |
| 2,804,257 | A | 8/1957 | Hasler et al. |
| 2,859,899 | A | 11/1958 | Kramer et al. |
| 2,870,954 | A | 1/1959 | Kulesza |
| 2,891,700 | A | 6/1959 | Maynard |
| 2,920,798 | A | 1/1960 | Samuel |
| 3,081,911 | A | 3/1963 | Scholle |
| 3,083,875 | A | 4/1963 | Welty et al. |
| 3,090,526 | A | 5/1963 | Hamilton et al. |

(Continued)

OTHER PUBLICATIONS

Judgment; filed in *Decosonic Sales Corporation* v. *Tilia, Inc. et al.*; Case No. C 92 0543-FMS; in the United States District Court for the Northern District of California; Jan. 25, 1994 (2 sheets).

(Continued)

*Primary Examiner*—Kevin Shaver
*Assistant Examiner*—Stephanie Willatt
(74) *Attorney, Agent, or Firm*—Cox Smith Matthews Incorporated

(57) ABSTRACT

This invention is directed to an improved collapsible bag having a spout and one or more grooves on the interior surface of a wall of the bag. The grooves, which are integral to a wall of the bag rather than on a separate evacuation strip, are in liquid communication with the spout and are sized such that the opposing wall of the bag is not completely forced into the grooves under the suction of conventional pumps which are used to withdraw the liquid from the bag. Thus, the grooves enable substantially complete withdrawal of the liquid from the bag without the use of an evacuation strip. Additionally, the present invention may be used in any orientation and does not require a slanted rack. Although the primary intended application of the present invention is in bag-in-box packages for containing and dispensing beverages, this invention may also be used to advantage in other liquid dispensing applications.

15 Claims, 3 Drawing Sheets

U.S. PATENT DOCUMENTS

| | | | |
|---|---|---|---|
| 3,142,599 | A | 7/1964 | Chavannes |
| 3,171,571 | A | 3/1965 | Daniels |
| 3,197,073 | A | 7/1965 | Gondra et al. |
| 3,257,036 | A | 6/1966 | Micallef |
| 3,260,412 | A | 7/1966 | Larkin |
| 3,342,377 | A | 9/1967 | Peredy |
| 3,361,303 | A | 1/1968 | Jacuzzi |
| 3,411,698 | A | 11/1968 | Reynolds |
| 3,420,413 | A | 1/1969 | Corsette |
| 3,549,050 | A | 12/1970 | Bruce et al. |
| 3,587,794 | A | 6/1971 | Mattel |
| 3,695,314 | A | 10/1972 | Watts et al. |
| 3,718,236 | A | 2/1973 | Reyner et al. |
| 3,809,217 | A | 5/1974 | Harrison |
| 3,838,794 | A | 10/1974 | Cogley et al. |
| 3,958,693 | A | 5/1976 | Greene |
| 3,981,415 | A | 9/1976 | Fowler et al. |
| 3,988,499 | A | 10/1976 | Reynolds |
| 4,014,461 | A | 3/1977 | Harvill |
| 4,062,475 | A | 12/1977 | Harris et al. |
| 4,087,026 | A | 5/1978 | Petterson |
| 4,093,068 | A | 6/1978 | Smrt |
| 4,137,930 | A | 2/1979 | Scholle |
| 4,138,036 | A | 2/1979 | Bond |
| 4,148,416 | A | 4/1979 | Gunn-Smith |
| 4,159,790 | A | 7/1979 | Bailey |
| 4,193,518 | A | 3/1980 | Holmes |
| 4,257,535 | A | 3/1981 | Mellett |
| 4,265,373 | A | 5/1981 | Stoody |
| 4,266,692 | A | 5/1981 | Clark |
| 4,270,533 | A | 6/1981 | Andreas |
| 4,284,671 | A | 8/1981 | Cancio et al. |
| 4,286,636 | A | 9/1981 | Credle |
| 4,322,020 | A | 3/1982 | Stone |
| 4,362,255 | A | 12/1982 | Bond |
| 4,381,846 | A | 5/1983 | Heck |
| 4,445,550 | A | 5/1984 | Davis et al. |
| 4,449,243 | A | 5/1984 | Platel |
| 4,513,884 | A | 4/1985 | Magid |
| 4,524,458 | A | 6/1985 | Pongrass et al. |
| 4,551,379 | A | 11/1985 | Kerr |
| 4,576,283 | A | 3/1986 | Fafournoux |
| 4,579,756 | A | 4/1986 | Edgel |
| 4,601,410 | A | 7/1986 | Bond |
| 4,683,702 | A | 8/1987 | Vis |
| 4,756,422 | A | 7/1988 | Kristen |
| 4,826,045 | A | 5/1989 | Price et al. |
| 4,893,731 | A | 1/1990 | Richter |
| 4,913,316 | A | 4/1990 | Richter |
| 4,939,151 | A | 7/1990 | Bacehowski et al. |
| 4,978,025 | A | 12/1990 | Fougeres |
| 4,998,990 | A | 3/1991 | Richter et al. |
| 5,147,071 | A | 9/1992 | Rutter et al. |
| RE34,929 | E | 5/1995 | Kristen |
| 5,566,851 | A | 10/1996 | Sasaki et al. |
| 5,647,511 | A | 7/1997 | Bond |
| 5,728,086 | A | 3/1998 | Niedospial, Jr. |
| 5,743,435 | A | 4/1998 | Tomic |
| 5,749,493 | A | 5/1998 | Boone et al. |
| 5,788,121 | A | 8/1998 | Sasaki et al. |
| 5,915,596 | A | 6/1999 | Credle, Jr. |
| 5,941,421 | A | 8/1999 | Overman et al. |
| 6,027,438 | A | 2/2000 | Frazier et al. |
| 6,045,006 | A | 4/2000 | Frazier et al. |
| 6,073,807 | A | 6/2000 | Wilford et al. |
| 6,102,252 | A | 8/2000 | Overman et al. |
| 6,105,821 | A | 8/2000 | Christine et al. |
| 6,170,715 | B1 | 1/2001 | Evans |
| 6,179,173 | B1 | 1/2001 | Frazier et al. |
| 6,607,097 | B1 | 8/2003 | Savage et al. |
| 6,715,644 | B1 | 4/2004 | Wilford |
| 6,851,579 | B1 | 2/2005 | Savage et al. |

OTHER PUBLICATIONS

Plaintiffs Further Briefing on Issue of Infringement Under the Doctrine of Equivalents; filed in *Decosonic Sales of Corporation* v. *Tilia, Inc., et al.*; Case No. C 92 0543-FMS; in the United States District Court for the Northern District of California; Jun. 4, 1993 (24 sheets).

Supplemental Brief of Tilia and Nationwide Marketing on Equivalents Issues; filed in *Decosonic Sales Corporation* v. *Tilia, Inc., et al.*, Case No. C 92 0543-FMS; in the United States District Court for the Northern District of California; Jun. 4, 1993 (44 sheets).

Supplemental Declaration of Hanns J. Kristen in Opposition to Motion for Summary Judgment; filed in *Decosonic Sales Corporation* v. *Tilia, Inc., et al.*; Case No. C 92 0543-FMS; in the United States District Court for the Northern District of California; Jun. 3, 1993 (12 sheets).

Transcript of Proceedings Hearing on Motion for Partial Summary Judgment on Non-Infringement; filed in *Decosonic Sales Corporation* v. *Tilia, Inc., et al.*; Case No. C 92 0543-FMS; in the United States District Court for the Northern District of California; May 20, 1993 (29 sheets).

Order Granting Summary Judgment; filed in *Decosonic Sales Corporation* v. *Tilia, Inc., et al.*; Case No. C 92 0543-FMS; in the United States District Court for the Northern District of California; May 18, 1993 (15 sheets).

Savage, et al., U.S. Provisional Appl. No. 60/164,699, filed Nov. 10, 1999 (26 sheets).

COLLAPSIBLE CONTAINER FOR LIQUIDS

CROSS-REFERENCE TO RELATED APPLICATIONS

This application is a continuation of U.S. patent application Ser. No. 10/257,351 filed, Apr. 1, 2003 now abandoned which is the national stage of PCT/US01/12203 filed Apr. 13, 2001, which claims priority from U.S. Provisional Application Ser. No. 60/196,838 filed on Apr. 13, 2000, the disclosures of which are incorporated herein by reference.

BACKGROUND OF THE INVENTION

1. Field of the Invention

This invention relates generally to an apparatus for containing and dispensing liquid. More specifically, this invention is directed to a collapsible container for use in a bag-in-box apparatus.

2. Description of the Related Art

In the field of post-mix beverage systems, an apparatus commonly known as a bag-in-box package is used to store and dispense beverages such as soft drinks. Typically, such bag-in-box packages comprise a collapsible bag or bladder disposed within a cardboard box. The bag has a spout for filling the bag with liquid, and the spout protrudes through a wall of the box for dispensing the liquid from the bag, usually by connection to a pump. One of the problems associated with such bag-in-box packages is that the bag collapses upon itself as the liquid is withdrawn, which tends to create pockets of liquid that are isolated from the spout and cannot be withdrawn from the bag. Thus, the residual portion of liquid remaining in the bag is wasted.

One possible solution to the foregoing problem is to place an evacuation strip inside the bag as shown, for example, in U.S. Pat. No. 5,749,493 to Boone et al. The bag of the '493 patent contains an elongated, narrow, flexible evacuation strip comprising a plurality of upstanding ribs. The evacuation strip is attached to the inner surface of one of the bag walls. A spout is disposed through a wall of the bag, and the evacuation strip is in liquid communication with the spout. As the bag collapses upon withdrawal of the liquid through the spout, the ribs of the evacuation strip prevent the walls of the bag from isolating pockets of liquid from the spout. The evacuation strip thus enables substantially complete withdrawal of the liquid from the bag. However, the evacuation strip adds an extra complication to the bag manufacturing process.

Another possible attempt to solve the problem of incomplete withdrawal of the liquid from such bag-in-box packages is to place the packages on slanted racks. By orienting the package such that the spout is at the lowest possible point, gravity will assist in forcing the liquid toward the spout. However, the need for a special slanted rack is a disadvantage to such an arrangement. Another disadvantage is the required orientation of the spout in a particular position, namely, at the lowest possible point.

In light of the foregoing disadvantages, it would be a significant advancement in the art of liquid dispensing to provide a collapsible container for use in a bag-in-box package that would enable substantially complete withdrawal of the liquid from the container without the use of an evacuation strip or slanted rack.

SUMMARY OF THE INVENTION

Accordingly, this invention is directed to an improved collapsible bag having a spout and one or more grooves on the interior surface of a wall of the bag. The grooves, which are integral to a wall of the bag rather than on a separate evacuation strip, are in liquid communication with the spout and are sized such that the opposing wall of the bag is not completely forced into the grooves under the suction of conventional pumps which are used to withdraw the liquid from the bag. Thus, the grooves enable substantially complete withdrawal of the liquid from the bag without the use of an evacuation strip. Additionally, the present invention may be used in any orientation and does not require a slanted rack. Although the primary intended application of the present invention is in bag-in-box packages for containing and dispensing beverages, this invention may also be used to advantage in other liquid dispensing applications.

BRIEF DESCRIPTION OF THE DRAWINGS

This invention may best be understood by reference to the following drawings.

DETAILED DESCRIPTION OF A PREFERRED EMBODIMENT

Figure 2:
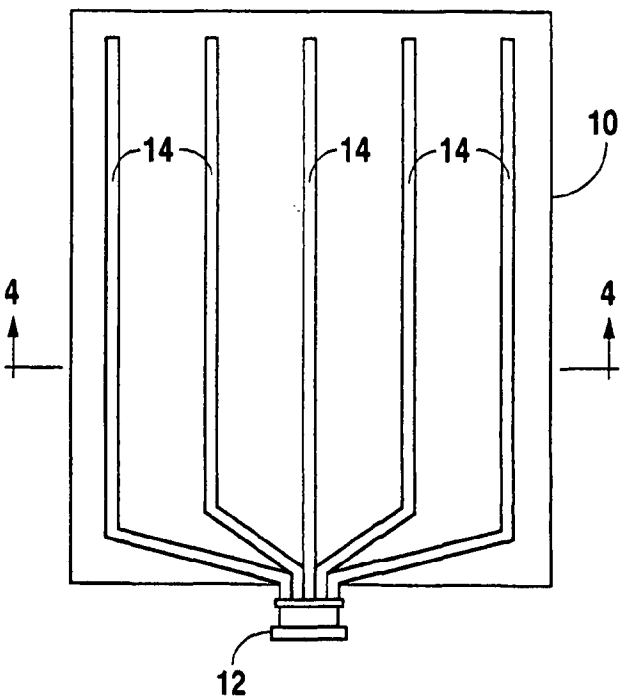
FIG. 2 is a cut-away top view illustrating the interior of the bottom wall of the collapsible bag of FIG. 1.
Figure 1:
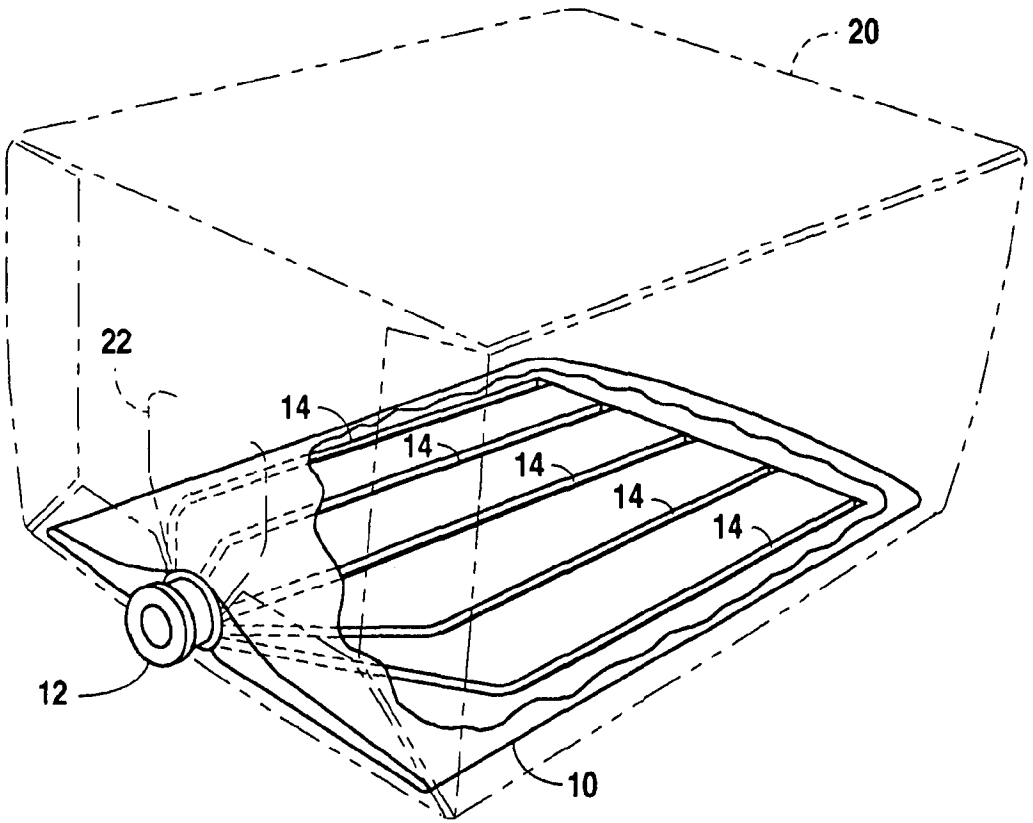
FIG. 1 is a perspective view of a collapsible bag in accordance with the present invention disposed within a box.

Referring to FIG. 1, a preferred embodiment of this invention comprises a collapsible bag 10 having a spout 12 and a plurality of grooves 14 on the interior of the bottom wall of bag 10. Bag 10, which is useful for containing and dispensing a liquid such as a beverage (not shown), is adaptable for insertion into a box 20 to form a bag-in-box apparatus. Spout 12 protrudes through a flap opening 22 of box 20. FIG. 2 more clearly illustrates the interior of the bottom wall of bag 10 with grooves 14, which are in liquid communication with spout 12. As liquid is dispensed from spout 12, bag 10 gradually collapses. However, grooves 14 prevent the walls of bag 10 from sealing off the liquid from spout 12, which enables substantially complete evacuation of the liquid from bag 10. Collapsible bag 10 may be made of a pair of sheets of flexible material, such as a thermoplastic, polynylon, metallized plastic, or other suitable material, joined at the peripheries by means known in the art, such as heat sealing or a suitable adhesive. The flexible sheets form the walls of the bag 10. Spout 12 may be attached to a wall of bag 10 by similar means. Grooves 14 may be formed in a bag wall by a variety of manufacturing techniques, such as extrusion, molding, machining, stamping, or pressing. Although FIGS. 1 and 2 show grooves 14 in the bottom bag wall, alternatively grooves 14 may be formed in the upper bag wall. Additionally, although FIGS.

1 and 2 show spout 12 and grooves 14 disposed on the same bag wall, spout 12 and grooves 14 may be on opposite bag walls so long as grooves 14 are in liquid communication with spout 12 as bag 10 collapses. For the sake of clarity, FIG. 1 does not show stiffener 16 as illustrated in FIG. 6 and discussed below.

Figure 3:
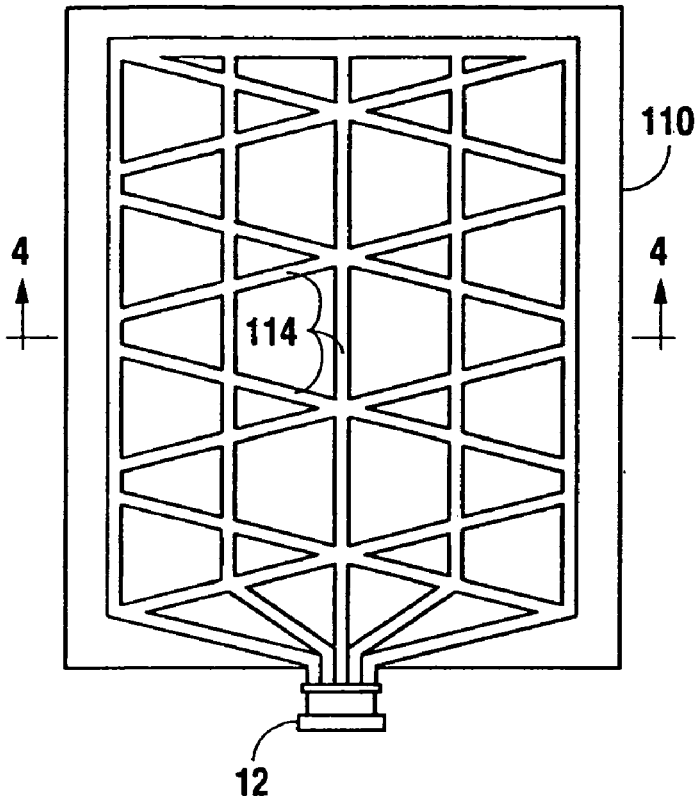
FIG. 3 is a cut-away top view illustrating the interior of the bottom wall of an alternative embodiment of a collapsible bag in accordance with the present invention.
Figure 4:
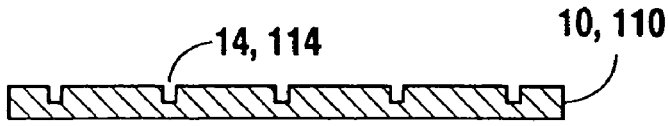
FIG. 4 is a sectional view taken along line 4—4 of FIG. 2 or FIG. 3.
Figure 5:
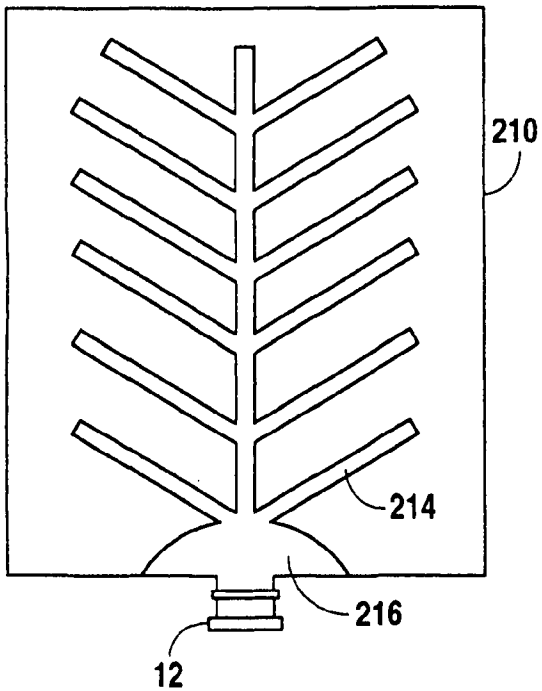
FIG. 5 is a cut-away top view illustrating the interior of the bottom wall of another alternative embodiment of a collapsible bag in accordance with the present invention.

FIG. 3 illustrates an alternative bag 110 having a grid-like pattern of grooves 114 on the interior of the bottom wall of bag 110. Grooves 114 are in liquid communication with spout 12 to allow substantially complete withdrawal of the liquid from bag 110. FIG. 4 illustrates the cross-sectional view taken at line 4—4 of either FIG. 2 or FIG. 3. As shown in FIG. 4, a majority of the bag wall in which the grooves 14, 114 are formed may have a first thickness, and the bag wall may have a second thickness delimited by one or more of the grooves such that the first thickness is greater than the second thickness. Grooves 114 may be in a variety of different patterns other than the pattern shown in FIG. 3. For example, a chevron groove pattern 214 feeding into a collection zone 216 in the vicinity of spout 12 is shown on bag 210 in FIG. 5. Again, although FIGS. 3 and 5 show grooves 114 and 214 in the bottom bag wall, grooves 114 and 214 may be formed in the upper bag wall, and spout 12 and grooves 114, 214 may be on opposite bag walls so long as grooves 114, 214 are in liquid communication with spout 12 as bag 110, 210 collapses.

Figure 7:
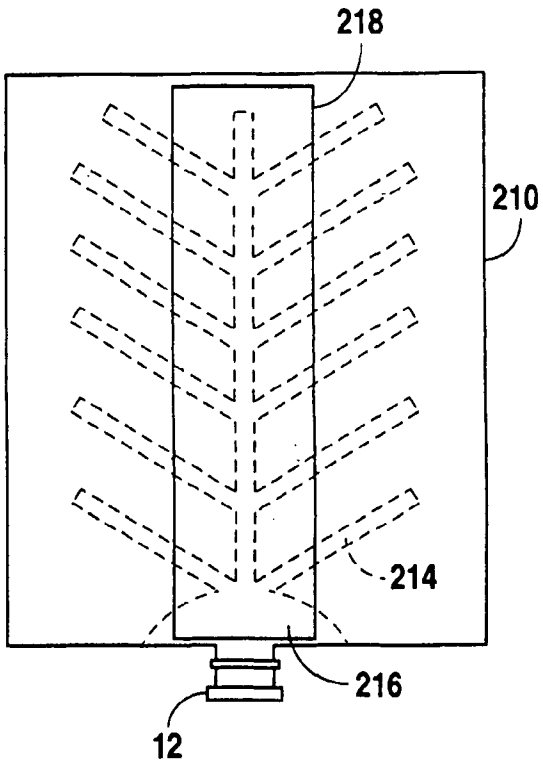
FIG. 7 is a top view of the collapsible bag of FIG. 5.
Figure 6:
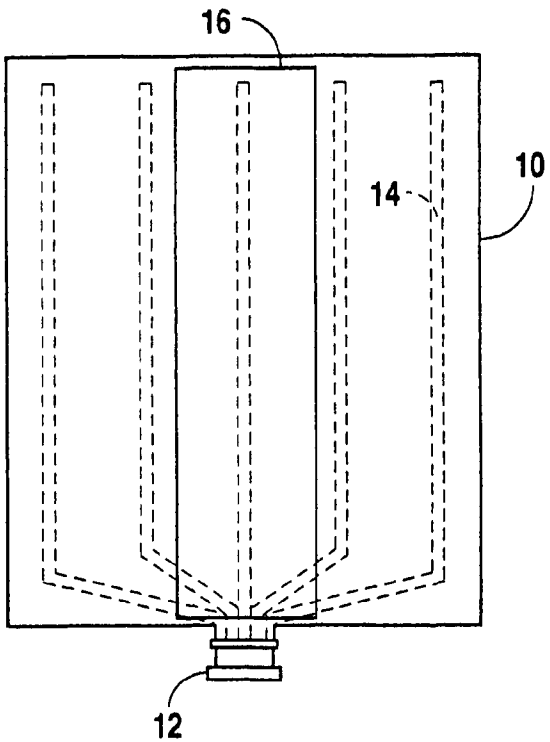
FIG. 6 is a top view of the collapsible bag of FIG. 1.

As shown in FIG. 6, the top of bag 10 may be provided with a stiffener 16 to help guard against the complete collapse of the bag upon itself and the consequent trapping of residual liquid inside the bag. As bag 10 collapses upon withdrawal of the liquid, stiffener 16 will overlie at least one groove 14. The stiffness of stiffener 16 prevents it from being sucked into groove 14 and blocking the liquid from spout 12. FIG. 7 illustrates a similar stiffener 218 on bag 210.

Although the foregoing specific details describe a preferred embodiment of this invention, persons reasonably skilled in the art of liquid dispensing will recognize that various changes may be made in the details of the apparatus of this invention without departing from the spirit and scope of the invention as defined in the appended claims. Therefore, it should be understood that this invention is not to be limited to the specific details shown and described herein.

I claim:

1. A collapsible container for use in containing and dispensing a liquid, comprising:

a flexible bag having a bag wall with an interior surface, said interior surface having at least one groove; and a spout disposed through said bag wall for dispensing liquid from said bag;

wherein a majority of said bag wall has a first thickness and said bag wall has a second thickness delimited by said at least one groove, wherein said first thickness is greater than said second thickness;

wherein said at least one groove is in liquid communication with said spout as said bag collapses to permit substantially complete withdrawal of liquid from said bag.

2. The collapsible container of claim 1 wherein said at least one groove comprises a plurality of grooves having elongated portions oriented substantially parallel to each other.

3. The collapsible container of claim 1 wherein said at least one groove comprises a plurality of grooves interconnected in a grid-like pattern.

4. The collapsible container of claim 1 wherein said at least one groove comprises a plurality of grooves interconnected in a chevron pattern.

5. The collapsible container of claim 1 wherein said at least one groove comprises a plurality of grooves that feed into a collection zone adjacent said spout.

6. The collapsible container of claim 1 wherein said flexible bag further comprises a stiffener that overlies said at least one groove as said flexible bag collapses to help maintain liquid communication between said at least one groove and said spout.

7. A collapsible container for use in containing and dispensing a liquid, comprising:

a flexible bag having a first bag wall and a second bag wall, said first bag wall having an interior surface with at least one groove; and a spout disposed through said second bag wall for dispensing liquid from said bag;

wherein a majority of said first bag wall has a first thickness and said first bag wall has a second thickness delimited by said at least one groove, wherein said first thickness is greater than said second thickness;

wherein said at least one groove is in liquid communication with said spout as said bag collapses to permit substantially complete withdrawal of liquid from said bag.

8. The collapsible container of claim 7 wherein said at least one groove comprises a plurality of grooves having elongated portions oriented substantially parallel to each other.

9. The collapsible container of claim 7 wherein said at least one groove comprises a plurality of grooves interconnected in a grid-like pattern.

10. The collapsible container of claim 7 wherein said at least one groove comprises a plurality of grooves interconnected in a chevron pattern.

11. The collapsible container of claim 7 wherein said flexible bag further comprises a stiffener that overlies said at least one groove as said flexible bag collapses to help maintain liquid communication between said at least one groove and said spout.

12. The collapsible container of claim 11 wherein said stiffener is connected to said second bag wall.

13. A collapsible container for use in containing and dispensing a liquid, comprising:

a flexible bag having a bag wall with an interior surface, said interior surface having at least one groove; and a spout disposed through said bag wall for dispensing liquid from said bag;

wherein said at least one groove is in liquid communication with said spout as said bag collapses to permit substantially complete withdrawal of liquid from said bag;

wherein said bag further comprises a stiffener that overlies said at least one groove as said bag collapses to help maintain liquid communication between said at least one groove and said spout.

14. A collapsible container for use in containing and dispensing a liquid, comprising:

a flexible bag having a first bag wall and a second bag wall, said first bag wall having an interior surface with at least one groove; and a spout disposed through said second bag wall for dispensing liquid from said bag;

wherein said at least one groove is in liquid communication with said spout as said bag collapses to permit substantially complete withdrawal of liquid from said bag;

wherein said bag further comprises a stiffener that overlies said at least one groove as said bag collapses to help maintain liquid communication between said at least one groove and said spout.

15. The collapsible container of claim 14 wherein said stiffener is connected to said second bag wall.

* * * * *